United States Patent [19]

Matthews, Jr. et al.

[11] 4,322,104

[45] Mar. 30, 1982

[54] DOOR GUARD

[75] Inventors: Edward H. Matthews, Jr.; William A. White, Jr., both of Ames, Iowa

[73] Assignee: Iowa State University Research Foundation, Inc., Ames, Iowa

[21] Appl. No.: 168,493

[22] Filed: Jul. 14, 1980

[51] Int. Cl.[3] ..... E05C 15/02

[52] U.S. Cl. ..... 292/288; 292/92

[58] Field of Search ..... 292/21, 92, 258, 288

[56] References Cited

U.S. PATENT DOCUMENTS 3,073,142 1/1963 Stebbins ..... 292/92 X
3,383,130 5/1968 De Avila ..... 292/92
3,788,688 1/1974 Chandler ..... 292/92
4,065,160 12/1977 Gilmore, Jr. ..... 292/92

*Primary Examiner*—Richard E. Moore
*Attorney, Agent, or Firm*—Zarley, McKee, Thomte, Voorhees & Sease

[57] ABSTRACT

The door guard of the present invention utilizes an L-shaped bar which binds against the panic bar of the door and against the door frame to prevent the panic bar from being pulled down and thus opening the door. The L-shaped bar has a front and side leg. The front leg has attached to it an upper and lower tab which fits one on either side of the panic bar. The side leg binds against the door frame.

4 Claims, 7 Drawing Figures

DOOR GUARD

BACKGROUND OF THE INVENTION

A certain type of door commonly used in public buildings is constructed so that a panic bar on the inside of the door is attached to the latching mechanism of the door. By pulling or pushing down on the panic bar, the latch releases and the door can be opened. When the door is locked, one may still exit by pushing downwardly on the panic bar and the door will remain locked when it closes behind the person, thus preventing entry into the building when the doors are locked. This door, though, is not foolproof to thieves. For example, a thief can drill a small hole through the door and insert a wire with a hook thereon through the hole. The door can then be opened by placing the hook over the panic bar and pulling downwardly, thus releasing the latch.

The door guard of the present invention prevents the panic bar from being used to open the door.

Accordingly, a primary object of the present invention is the provision of a door guard which prevents a panic bar from being used to open the door.

A further object of the present invention is the provision of a door guard which allows a person to exit through the door.

A further object of the present invention is the provision of a door guard which is simple in construction, durable in use and efficient in operation.

SUMMARY OF THE INVENTION

The present invention utilizes an L-shaped bar which when in place, prevents the panic bar of a door from being pulled or pushed down and therefore preventing the door from being opened. The L-shaped bar has a front leg which is parallel to the panic bar and a side leg which is perpendicular to the panic bar. The side leg binds against the door frame. The front leg has attached to it an upper and lower tab perpendicular to the panic bar which fit one on either side thereof. The tabs prevent the panic bar from being pulled down while at the same time holding the door guard in place. The door guard can be sufficiently moved by a person wishing exit through the door to allow such person to push down the panic bar and open the door. As the door closes behind the person, the door guard may be placed back into position to prevent the panic bar from being pulled or pushed down, and will close behind the person exiting and return to its "safe" state.

DETAILED DESCRIPTION OF THE INVENTION

Figure 1:
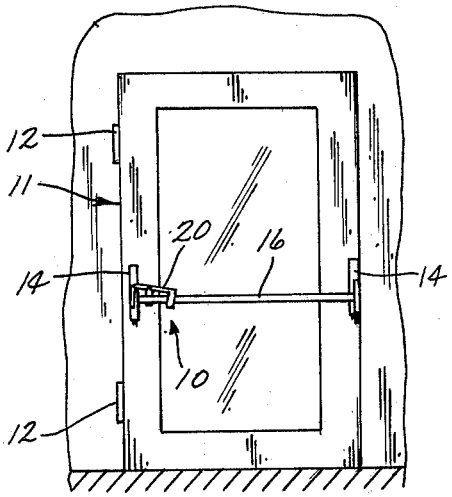
FIG. 1 is a view showing the door guard in position on the panic bar.
Figure 2:
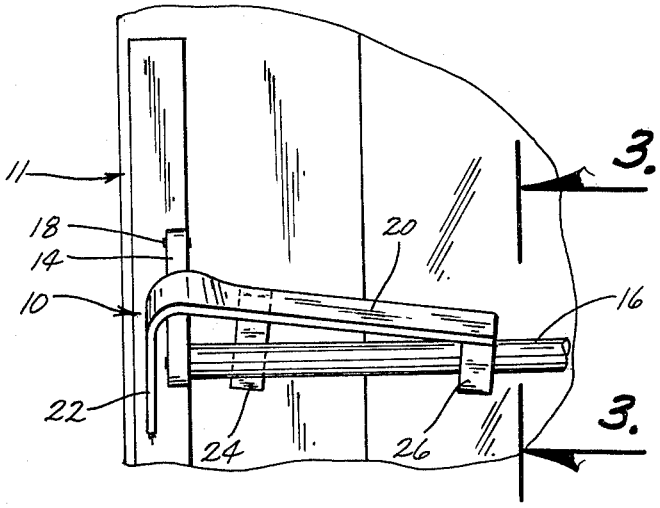
FIG. 2 is an enlarged view of FIG. 1.
Figure 3:
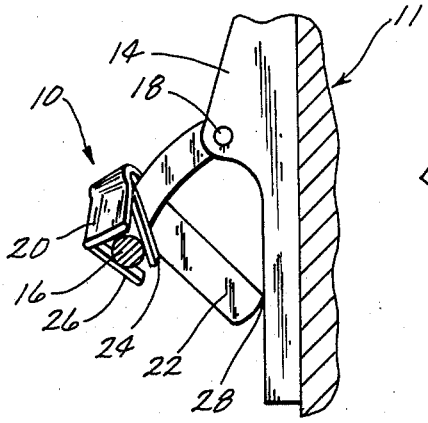
FIG. 3 is a view along line 3—3 of FIG. 2, showing the upper and lower tab being on either side of the panic bar and the side leg binding against the door frame.
Figure 4:
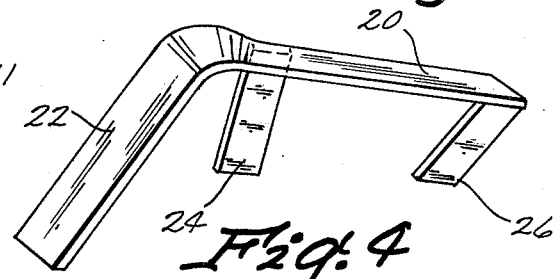
FIG. 4 is an elevational view of the door guard.
Figure 6:
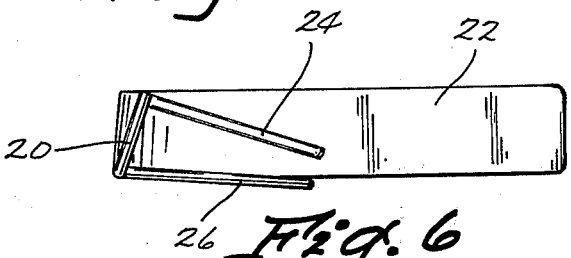
FIG. 6 is an end view of the door guard along line 6—6 of FIG. 5.
Figure 5:
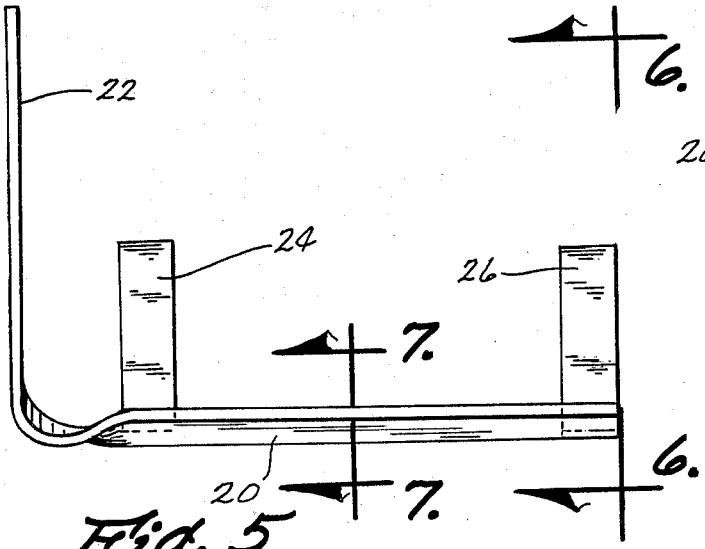
FIG. 5 is a plan view of the door guard.
Figure 7:
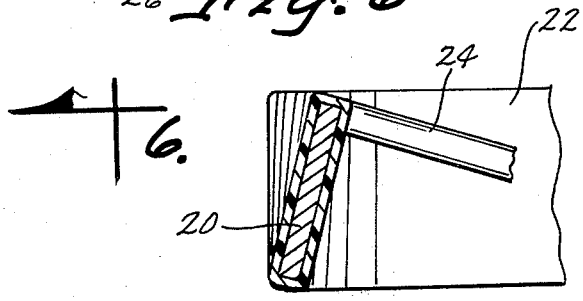
FIG. 7 is a view along line 6—6 of FIG. 5, showing the relation of the front leg, upper tab and side leg.

Referring to the drawings, numeral 10 generally designates the door guard and numeral 11 generally designates the door.

The door 11 has hinges 12, a latching mechanism 14, a panic bar 16 and a pivotal point 18 for the panic bar 16. The door guard 10 is an L-shaped bar comprising a front leg 20, a side leg 22, an upper tab 24, and a lower tab 26.

The side leg 22 and the upper and lower tabs 24 and 26, respectively, are all generally perpendicular to the front leg 20, and all extend in the same general direction therefrom. The side leg 22 is integrally connected to one end of the front leg 20. The upper tab 24 is integrally connected to the upper side of the front leg 20 and near the side leg 22. The lower tab 26 is integrally connected to the bottom edge of the front leg 20 at the end opposite that having the side leg 22.

When the door guard 10 is in position, the front leg 20 is approximately parallel to the longitudinal axis of the panic bar 16 while the side leg 22, upper tab 24 and lower tab 26 are all approximately perpendicular thereto. The upper tab 24 engages the top side of the panic bar 16 towards door 11 while the lower tab 26 engages the opposite bottom side thereof. The side leg 22 binds against the frame of the door 11 outside the pivotal point 18 and at a point 28 below the panic bar 16. When in this position, the panic bar is inoperative to open the door.

If the building custodian wishes to leave the building, the door guard can be lifted from the panic bar, and the bar can be pivoted to open the door. Before the door closes, the door guard can then be replaced on the bar on the hinge side of the door. The door can then be closed, and the door guard will thereupon resume its operative position. Admission to the building by the custodian is thereupon gained through a door that has a conventional key-bolt assembly without a panic bar.

From the foregoing, it is seen that this invention will achieve at least all of its stated objectives.

What is claimed is:

1. The combination of a door structure including a door frame, and a door having opposite sides, hinges on one side of said door connected to said frame, a latch mechanism, a horizontal panic bar pivotally secured to said door and operatively connected to said latch mechanism, and a stop means for said panic bar, comprising, an L-shaped bar having a front leg normally parallel to said panic bar, and a side leg perpendicular to said panic bar, means on said front leg detachably embracing said panic bar and holding said L-shaped bar so that said side leg will engage and bind against said door frame to prevent pivotal movement of said panic bar with respect to said door.

2. The combination according to claim 1 wherein said front leg has integrally connected thereto upper and lower tabs extending perpendicular with respect to said panic bar, and in the same direction as said side leg.

3. A door guard means adapted for mounting on the pivotal panic bar of a door to render said panic bar inoperative for pivotal movement, comprising, an L-shaped bar having a front leg normally parallel to a panic bar upon which it is mounted, and a side leg normally perpendicular to said front leg;

means on said front leg for detachably embracing a panic bar so that said side leg can engage and bind against a door frame to which the door of said panic bar is mounted to prevent pivotal movement of said panic bar with respect to said door.

4. The door guard of claim 3 wherien said front leg has integrally connected thereto upper and lower tabs extending perpendicular with respect to said panic bar and in the same direction as said side leg.

* * * * *